252-99 AU 166 EX
12/23/80 XR 4,240,918

United States Patent [19]
Lagasse et al.

[11] 4,240,918
[45] Dec. 23, 1980

[54] ANTI-SOILING AND ANTI-REDEPOSITION ADJUVANTS AND DETERGENT COMPOSITIONS COMPRISED THEREOF

[75] Inventors: Alain Lagasse, Creteil; Bernard Papillon, La Mulatiere, both of France

[73] Assignee: Rhone-Poulenc Industries, Paris, France

[21] Appl. No.: 957,058

[22] Filed: Nov. 2, 1978

[30] Foreign Application Priority Data

Nov. 2, 1977 [FR] France ..... 77 33486

[51] Int. Cl.[2] ..... C11D 7/54; C11D 3/20; C11D 3/26

[52] U.S. Cl. ..... 252/95; 8/137; 252/99; 252/174.23; 252/541; 252/544; 252/DIG. 2; 252/15; 260/29.2 TN; 260/31.8 M; 260/31.8 XA; 521/905; 525/457; 525/458; 528/83; 528/904

[58] Field of Search ..... 8/137, 192; 252/8.6, 252/8.75, 89, 95, 99, 541, 544, DIG. 2, 174.23; 260/29.2 TN, 31.2 XA, 31.8 XA, 31.8 M; 521/905; 525/457–458; 528/83, 904

[56] References Cited

U.S. PATENT DOCUMENTS

| | | | |
|---|---|---|---|
| 3,503,915 | 3/1970 | Peterson | 260/29.2 |
| 3,521,993 | 7/1970 | Swidler et al. | 8/115.6 |
| 3,660,010 | 5/1972 | Georgoudis et al. | 8/115.6 |
| 3,896,035 | 7/1975 | Schultz et al. | 252/8.75 |
| 3,962,152 | 6/1976 | Nicol et al. | 252/551 |
| 4,020,015 | 4/1977 | Bevan | 252/544 |
| 4,068,035 | 1/1978 | Violland et al. | 428/279 |
| 4,088,610 | 5/1978 | Bevan et al. | 252/541 |
| 4,107,056 | 8/1978 | Violland et al. | 252/8.8 |
| 4,132,680 | 1/1979 | Nicol | 252/547 |
| 4,152,273 | 5/1979 | Weiland | 252/8.8 |

*Primary Examiner*—P. E. Willis, Jr.
*Attorney, Agent, or Firm*—Burns, Doane, Swecker & Mathis

[57] ABSTRACT

Novel anti-soiling and anti-redeposition adjuvants for detergent compositions include at least one polymer A, said polymer itself having anti-soiling and anti-redeposition properties, at least one solubilizing and dispersing agent B for said polymer A, and at least one water repellent C for said agent B.

36 Claims, No Drawings

ANTI-SOILING AND ANTI-REDEPOSITION ADJUVANTS AND DETERGENT COMPOSITIONS COMPRISED THEREOF

BACKGROUND OF THE INVENTION

1. Field of the Invention

The present invention relates to novel adjuvants for detergency, a process for their preparation and the use thereof as anti-soiling and anti-redeposition agents in detergent compositions, especially those employed for washing textile articles and, in particular, articles containing polyester fibers.

2. Description of the Prior Art

Presently, serious detergency problems are encountered in view of the increasingly important development of polyester fibers. In fact, it is known that cloths containing a considerable proportion of polyester fibers, e.g., Dacron, tend to be very hydrophobic. This characteristic enables greasy stains to become fixed on the fabric on or into which they have been deposited and such phenomenon, accordingly, makes them difficult to remove. A further well-known disadvantage of polyester fibers is that, during washing, soiling matter present in the washing bath can be deposited on the fabric. Furthermore, polyester fibers become charged with static electricity, either when being worn or during the drying operation. One means of overcoming the above-mentioned disadvantages is to deposit, on the fibers, a finish which imparts a certain hydrophilic character thereto.

It has been proposed to produce this effect by adsorbing, on the polyester fibers, polymers containing hydrophobic units and hydrophilic units, joined to one another by an ester function [compare French Pat. No. 1,499,508] or by a urethane function [compare commonly assigned pending application, Ser. No. 804,391, filed June 7, 1977, itself a continuation-in-part of abandoned application, Ser. No. 748,296, filed Dec. 7, 1976].

The said polymers of the prior art exhibit properties of an anti-soiling agent by facilitating the removal of stains on cloths and properties of an anti-redeposition agent by maintaining the soiling matter in suspension, in order to prevent same from being redeposited during washing. However, although these polymers are effective when care has been taken to disperse them in water beforehand, they do not afford complete satisfaction when incorporated in the form of a powder in a detergent. When used at a low dose under such conditions, these products are insufficiently effective because of their poor redissolution during washing. Furthermore, the anti-soiling and anti-redeposition properties are not perfectly stable when these products are stored in a washing powder.

SUMMARY OF THE INVENTION

Accordingly, a major object of the present invention is to provide novel adjuvants for detergency which, when mixed in the form of a powder with a detergent, exhibit greatly improved anti-soiling and anti-redeposition properties, compared with the products previously known to this art. The term detergent, also referred to as detergent composition, is intended to connote a solid product containing at least one organic surface-active agent and at least one builder which is an assistant for detergency, one of the functions of which is to sequester the ions responsible for the hardness of the water.

A further object of the invention is to enable the said properties to be retained during storage of detergents comprised thereof.

Briefly, novel compositions have now been found, the anti-soiling and anti-redeposition characteristics of which are enhanced and the properties of which are retained longer upon incorporation of some in a detergent composition, characterized in that some comprise a mixture of at least one polymer A, itself displaying anti-soiling and anti-redeposition properties, one solubilizing or dispersing agent B for the said polymer A, and one water repellent C for the solubilizing agent B.

Per the invention, it has been found that, unexpectedly, the addition of a solubilizing agent B makes it possible to enhance the immediate effectiveness of the anti-soiling and anti-redeposition properties of the polymer A and that the addition of a water repellent C makes it possible to retain the said properties of the polymer A during the storage thereof while formulated in detergent compositions.

The compositions according to the invention, which are obtained from the aforementioned three constitutents in accordance with the process described below, are essentially in the form of a powder.

Any polymer exhibiting anti-soiling and anti-redeposition properties, and more particularly the polyurethanes and copolyesters, can be used as the polymer A which is capable of being employed in the said compositions.

DETAILED DESCRIPTION OF THE INVENTION

In the following account of the characterization of those polymers suitable for the present invention, the term hydroxyl number will denote the amount of potassium hydroxide, expressed as milligrams equivalent to the acetic acid required to esterify 1 gram of sample, and the term acid number will denote the number of milligrams of potassium hydroxide which are required to neutralize the free acids present in 1 gram of sample.

Examples of polyurethanes which can be used as the polymer A in the compositions according to the invention are those described in the pending application, Ser. No. 804,381, and its abandoned parent, Ser. No. 748,296, both hereby expressly incorporated by reference in their entirety and relied upon.

These are linear hydrophilic polyurethanes resulting from the reaction of 10 to 70% by weight of a polyester base, the acid number of which is less than 3 mg of KOH/g and the hydroxyl number of which is less than or equal to 375 mg of KOH/g, with 90 to 30% by weight of a prepolymer having terminal isocyanate groups, which is obtained by reacting at least one non-ionic hydrophilic macrodiol with at least one diisocyanate, the ratio of NCO/OH being between 0.8 and 1.

The polyester base which has terminal hydroxyl groups, and the acid number of which is less than or equal to 3, can be prepared, in known manner, by any polyesterification reaction using at least one diacid, one of its diesters or its anhydride, and at least one lower alkylene or cycloalkyl diol which does not impart a marked non-ionic hydrophilicity to the polyester.

Diacids which can be used are saturated or unsaturated aliphatic diacids and aromatic diacids, such as succinic, adipic, suberic and sebacic acids, maleic, fumaric and itaconic acids and orthophthalic, isophthalic and terephthalic acids, the anhydrides of these acids and their diesters, such as the methyl, ethyl, propyl and butyl diesters. The above-mentioned compounds can be employed either alone or in admixture.

Diols which can be used are aliphatic glycols such as ethylene glycol, diethylene glycol and higher homologues having a molecular weight which is less than or equal to 300, propane-1,2-diol, dipropylene glycol and higher homologues, butane-1,4-diol, hexane-1,6-diol, neopentylglycol and cycloaliphatic glycols such as cyclohexanediol and dicyclohexanediolpropane.

In certain cases, it can be of value to impart a weakly pronounced ionic character to the polyester base. In order to do this, a minor amount of a sulfonated diacid is incorporated during the preparation of the polyester, for example, by introducing, in known manner, 5-sulfoisophthalic acid or its dimethyl ester in the form of one of their alkali metal salts. In general, the ratio of the molar amount of sulfonated diacid to the total molar amount of diacids used in the polyester composition is less than or equal to 1:5.

Preferred polyester bases used in the polyurethane composition are those which are essentially prepared from terephthalic acid or one of its diesters. They preferably have a number-average molecular weight of between 300 and 4,000, which corresponds to a hydroxyl number $N_{OH}$ of between 25 and 375 mg of KOH/g.

The prepolymer having terminal isocyanate groups is prepared by reacting at least one non-ionic hydrophilic macrodiol with at least one diisocyanate. A non-ionic hydrophilic macrodiol which can be used is a polyoxyethylene glycol, the number-average molecular weight of which is generally between 300 and 6,000 and preferably between 300 and 4,000.

All aromatic, aliphatic or cycloaliphatic organic diisocyanates are suitable for carrying out the invention. However, some of these are more commonly used because of their current availability. These are essentially toluene-diisocyanates, hexamethylene-diisocyanate, isophorone-diisocyanates, hexamethylene-diisocyanate, isophorone-diisocyanate, di-(isocyanatophenyl)-alkanes, such as di-(isocyanatophenyl)-methane, and di-(isocyanatocyclohexyl)-alkanes, such as di-(isocyanatocyclohexyl)-methane.

The molar amount of diisocyanate to be employed relative to the overall amount of macrodiol and polyester base is determined by the molecular weight of the final polyurethane which it is desired to obtain.

The percentage by weight of diisocyanate in the final product is generally between 2 and 15%.

Since it is generally desired to obtain a final product of high molecular weight, the molar ratio of the NCO groups to the total hydroxyl groups employed is very close to 1, while, nevetheless, remaining less than 1. This ratio is generally between 0.8 and 1.

A preferred polyurethane is the product resulting from the condensation of a polyester base which has a number-average molecular weight of 300 to 4,000 and is essentially obtained from adipic acid (or one of its diesters) and/or terephthalic acid (or one of its diesters) and/or sulfoisophthalic acid in the form of its sodium salt (or one of its diesters) and at least one diol selected from the group comprising ethylene glycol, diethylene glycol and higher homologues having a molecular weight which is less than or equal to 300, butane-1,4-diol and propane-1,2-diol, with a prepolymer having terminal isocyanate groups, which is obtained by reacting at least one polyoxyethylene glycol, having a molecular weight of between 600 and 4,000, with at least one diisocyanate selected from the group comprising: hexamethylene-diisocyanate, toluene-diisocyanate and di-(isocyanatophenyl)-methane.

The operating conditions for the preparation of the polyester base, the prepolymer having terminal isocyanate groups and, finally, the polyurethane are described in the above-mentioned patent application.

As the polymer A, the invention also relates to copolyesters and, more particularly, those described in French Pat. No. 1,401,581, also hereby expressly incorporated by reference in its entirety and relied upon. The said copolyesters possess recurring units of alkylene terephthalate and of polyoxyalkylene terephthalate. The copolymers prepared from dimethyl terephthalate, ethylene glycol and polyoxyethylene glycol are preferably used. The copolyester generally contains from 10 to 50% by weight of ethylene terephthalate recurring units and from 90 to 50% by weight of polyoxyethylene terephthalate recurring units derived from a polyoxyethylene glycol having a number-average molecular weight of 1,000 to 4,000; the molar ratio of ethylene terephthalate units/polyoxyethylene terephthalate units is usually between 2 and 8.

The said copolyesters are prepared in accordance with the examples of said French Pat. No. 1,401,581.

A mixture of polyurethanes and copolyesters can be used as the anti-soiling and anti-redeposition agent without departing from the scope of the present invention. The polymer A which is preferred is a polyurethane is a polyurethane displaying those characteristics defined above.

The other two constituents used together with the polymer A in the compositions of the invention are a solubilizing or dispersing agent B, and a water repellent C.

As solubilizing or dispersing agents B which are capable of being employed in the said compositions, there are mentioned:

Polyoxyethylene glycols having a number-average molecular weight of between 1,000 and 30,000 and, more particularly, between 1,500 and 10,000; the said polyoxyethylene glycols can also be used in the form of an ester or diester of aliphatic fatty acids having from 12 to 20 carbon atoms. An example is polyoxyethylene glycol distearate having a number-average molecular weight of 6,000;

Non-ionic surface-active agents typically obtained by condensing an alkylene oxide, preferably ethylene oxide, with an organic compound which can either be aliphatic or alkylaromatic. Appropriate non-ionic surface-active agents include:

The polyoxyethyleneated aliphatic alcohols resulting from the condensation of ethylene oxide with linear or branched chain fatty alcohols having from 8 to 22 carbon atoms, at the rate of 5 to 80 mols of ethylene oxide per mole of fatty alcohol;

Polyoxyethyleneated alkylphenols, for example, the products resulting from the condensation of ethylene oxide with alkylphenols, at the rate of 5 to 80 mols of ethylene oxide per mol of alkylphenol, the alkyl radical being linear or branched and containing from 6 to 12 carbon atoms;

Polyoxyethyleneated tristyrylphenols which can be represented by the structural formula:

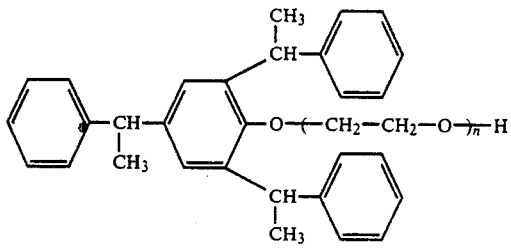

in which n can vary between 5 and 80 and preferably between 30 and 80;

Urea or its mono- or di-substituted derivatives such as N-alkylureas containing from 1 to 4 carbon atoms in the alkyl radical and N,N- or N,N'-dialkylureas containing 1 or 2 carbon atoms in the alkyl radical. Examples are N-methylurea, N-ethylurea, N-butylurea, N,N'-dimethylurea, N,N-diethylurea and N,N'-diethylurea;

The mono- or diglycerides obtained from glycerol and aliphatic fatty acids having from 12 to 20 carbon atoms, such as, for example, glycerol monostearate or glycerol dioleate;

Amides of aliphatic carboxylic acids possessing from 2 to 8 carbon atoms, such as acetamide, propionamide, pentanamide and diacetamide;

α-Hydroxylic aliphatic carboxylic acids having from 2 to 5 carbon atoms, such as, for example, glycolic acid, 2-hydroxypropanoic acid and 2-hydroxybutanoic acid.

Two most desirable but not strictly essential requirements govern the choice of the solubilizing or dispersing agent B from the above list, namely, that it should be soluble in water and have a melting point between 35° and 150° C., and preferably between 35° and 90° C.

Very particularly suitable solubilizing or dispersing agents from among those listed above are:

Polyoxyethylene glycols having a number-average molecular weight ranging from 2,000 to 8,000 and, in particular, those having a number-average molecular weight of 4,000 to 6,000;

The polyoxyethyleneated aliphatic alcohols resulting from the condensation of ethylene oxide with linear or branched chain fatty alcohols having from 8 to 22 carbon atoms, at the rate of 40 to 80 moles of ethylene oxide per mol of fatty alcohol;

The polyoxyethyleneated alkylphenols obtained by condensing ethylene oxide with alkylphenols, at the rate of 40 to 80 mols of ethylene oxide per mol of alkylphenol, the alkyl radical being linear or branched and containing from 6 to 12 carbon atoms; and Polyoxyethyleneated tristyrylphenols which can be represented by the structural formula:

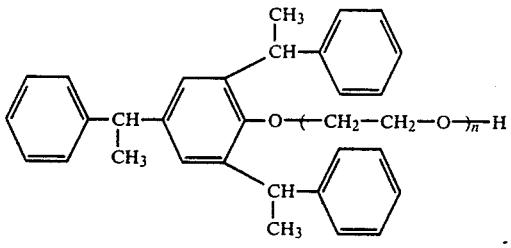

in which n can vary between 5 and 80 and preferably between 30 and 80.

As water repellents C which are adapted to be employed in the compositions of the present invention, there are mentioned, in particular:

Linear or branched chain saturated fatty acids having from 12 to 22 carbon atoms, such as lauric, myristic, palmitic, stearic, margaric and arachidic acids; and The microcrystalline waxes obtained by mixing normal paraffins, branched paraffins and naphthenic hydrocarbons having from 36 to 60 carbon atoms. The proportion of the various ingredients influences the hardness of the product obtained. The preferred waxes are hard microcrystalline waxes having a melting point between 50° and 90° C.

The compound selected as the water repellent C should have a melting point between 35° and 150° C., and preferably between 35° and 90° C.

Stearic acid is most preferred.

Preferably, the agents B and C are selected with melting points such that they are solids at ambient temperature (and thus can be incorporated in powdered form), but which are soluble under conditions of washing. If, for example the agent B is not completely soluble, a somewhat reduced washing efficiency will result.

The compositions of the present invention thus combine a polymer A, a solubilizing or dispersing agent B and a water repellent C in those amounts noted below.

The amount of solubilizing or dispersing agent B employed in the said compositions, expressed as the weight ratio [solubilizing or dispersing agent B/polymer A] can vary over wide limits; it has been found that, nonetheless, a ratio of at least 0.5 is very particularly suitable. The upper limit is not of a critical nature, but it is of no value to reach weight ratios greater than 5. The amount of solubilizing or dispersing agent B is preferably selected so that the said ratio is between 1 and 4.

The amount of water repellent C is defined by the weight ratio [water repellent C/solubilizing or dispersing agent B] which is preferably between 0.1 and 0.4, although it can be selected from a wider range extending from 0.03 to 1.

As regards the production of the components of the new mixtures described above, reference is made, in the case of the synthesis of the polymer A, to the methods of operation described in the noted copending application and abandoned parent application, Ser. Nos. 809,391 and 748,296.

As regards the process for the preparation of the anti-soiling and anti-redeposition compositions of the invention, which process itself constitutes a further subject of the invention, it is necessary to heat the polymer A, introduced into a container equipped with stirring means, to a temperature between 100° and 200° C., to add the solubilizing or dispersing agent B and, after homogenizing the mixture, to add the water repellent C. This is the preferred order of introduction of the various constituents, but the scope of the invention is not exceeded by modifying the order in which they are brought into mutual contact.

The product thus obtained is usually ground by any appropriate means. The particle size should be compatible with that of a washing powder, that is to say, the particles of the compositions of the invention typically have a diameter of between 0.1 and 2 mm; this diameter is preferably between 0.5 and 1 mm.

When conditioned in this manner, the compositions according to the invention are ready for incorporation into any type of detergent containing at least one anionic, non-ionic, cationic, ampholytic or zwitterionic surface-active agent and at least one detergent builder.

As examples of anionic surface-active agents which can be used, there are mentioned:

Alkali metal soaps, such as the sodium or potassium salts of saturated or unsaturated fatty acids having from 8 to 24 carbon atoms, and preferably from 14 to 20 carbon atoms, or derivatives of aminocarboxylic acids, such as sodium N-laurylsarcosinate and sodium N-acylsarcosinate;

Alkyl-, aryl- or alkylaryl-sulfonates, generally of alkali metals. Examples of alkylbenzenesulfonates are those of the formula $R_1C_6H_4SO_3M$ in which $R_1$ represents a nonyl, dodecyl or tridecyl radical and M represents a sodium atom, an ammonium radical or triethanolamine. Examples of naphthalene-sulfonates are those of the formula $R_2C_{10}H_6SO_3Na$ in which $R_2$ is a nonyl radical. Other sulfonates can be employed, such as the N-acyl-N-alkyltaurates of the formula $R_3—CO—N—R_3'—CH_2SO_3Na$, in which $R_3$ is an alkyl radical having from 11 to 18 carbon atoms and $R_3'$ is a methyl or ethyl radical, such as, for example sodium N-oleoyl-N-methyltaurate or N-palmitoyl-N-methyltaurate;

β-sulfoethyl esters of fatty acids, for example, of lauric, myristic and stearic acids; olefin-sulfonates containing from 12 to 24 carbon atoms, which are obtained by sulfonating an α-olefin, such as dodec-1-ene, tetradec-1-ene, hexadec-1-ene, octadec-1-ene, eicos-1-ene and tetracos-1-ene; with sulfur trioxide;

Sulfates and sulfated products; among the alkylsulfates corresponding to the formula $R_4OSO_3M$, there are mentioned those in which the radical $R_4$ is a lauryl, cetyl, oleyl or myristyl radical and M represents a sodium atom, an ammonium radical or triethanolamine; sulfated natural oils and fats; the disodium salt of sulfated oleic acid; sulfated alkanolamides such as, for example, the compound $C_{11}H_{23}—CONH—CH_2—CH_2—OSO_3Na$; the ethyl, propyl, butyl or amyl esters of sulfated oleic or ricinoleic acid; sulfated oxyethyleneated alkylphenols of the formula $R_5C_6H_4—O—(CH_2—CH_2)_n—OSO_3M$ in which $R_5$ is a nonyl or dodecyl radical and M is a sodium atom, an ammonium radical or triethanolamine; sulfated oxyethyleneated alcohols of the formula $R_6—(O—CH_2—CH_2)_n—OSO_3M$ in which $R_6$ is a lauryl or myristyl radical and M has the meaning given above;

Phosphates of optionally oxyethyleneated fatty alcohols. By way of illustration, there are mentioned alkyl or othophosphates and polyphosphates, it being possible for the said alkyl radical to be a hexyl, octyl, 2-ethylhexyl or decyl radical.

Compounds obtained by condensing an alkylene oxide with an organic compound which can be aliphatic or alkylaromatic can generally be used as non-ionic surface-active agents. Appropriate non-ionic surface-active agents are:

Oxyethyleneated alkylphenols, for example, the products resulting from condensation with ethylene oxide at the rate of 5 to 25 mols per mol of alkylphenol, the alkyl morety being linear or branched and containing from 6 to 12 carbon atoms. Nonylphenol condensed with about 10 to 30 mols of ethylene oxide per mol of phenol, dinonylphenol condensed with 15 mols of ethylene oxide per mol of phenol and dodecylphenol condensed with 12 mols of ethylene oxide per mole of phenol are noted as being especially advantageous;

The oxyethyleneated aliphatic alcohols resulting from the condensation, with ethylene oxide, of linear or branched chain fatty alcohols containing from 8 to 22 carbon atoms, for example, the product resulting from the condensation of about 15 mols of ethylene oxide with 1 mol of tridecanol or copra alcohol, and myristyl alcohol condensed with 10 mols of ethylene oxide;

Carboxylic acid amides such as, for example, the diethanolamide of optionally polyoxyethyleneated fatty acids, such as lauric acid, or of coconut oil; and Polyoxyethyleneated and polyoxypropyleneated fatty alcohols.

Cationic agents which can be employed are oxides of fatty amines, corresponding to the formulae:

$$R_7(CH_3)_2N\rightarrow O$$

or $$R_7(CH_2CH_2OH)_2N\rightarrow O$$

in which $R_7$ represents a cetyl, decyl, lauryl, myristyl, stearyl or oleyl radical.

Finally, it is possible to use amphoteric surface-active agents such as the alkyldimethylbetaines of the formula:

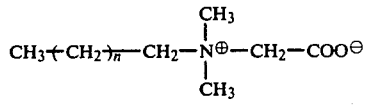

the alkylamidopropyldimethylbetaines of the formula:

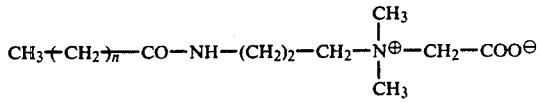

and the alkyltrimethylsulfobetaines of the formula:

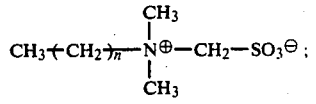

in the said formulae, n is between 9 and 16.

The various anionic, non-ionic and cationic surface-active agents which have been listed above, without implying a limitation, can be used by themselves or in admixture.

Among the above-mentioned surface-active agents, the sodium alkylbenzenesulfonates, sodium stearate, the sulfates of fatty alcohols, the sulfates of polyoxyethyleneated fatty alcohols and the polyoxyethyleneated fatty alcohols are very particularly suitable, and are preferably employed in the detergent compositions.

The detergents can additionally contain builders, one of the functions of which is to sequester the calcium and magnesium ions present in the water.

Carbonates, silicates, phosphates and polyphosphates are mentioned as examples of adjuvant alkali metal salts which can be used for this purpose. More precisely, pentasodium tripolyphosphate, tetrasodium and tetrapotassium pyrophosphate and trisodium orthophosphate will be mentioned.

Natural silicates of alumina or silicates which, inter alia, contain alumina, such as bentonite or vermiculite, and type A synthetic zeolites, are also suitable builders.

It is also envisaged to employ adjuvant organic alkali metal salts such as:

The sodium salt of aminopolycarboxylic acids such as nitrilotriacetic acid, ethylene diaminetetraacetic acid, diethylenetriaminepentaacetic acid, hydroxyethylethylenediaminetriacetic acid or dihydroxyethylglycine;

Hydroxycarboxylic acids which are optionally in the form of salts of acids such as citric, tartaric, gluconic or saccharic acid;

Sodium oxydiacetate; and

Organophosphorus compounds such as aminoalkylidenephosphonic acids and, more exactly, nitrile-tris-(methylene)-triphosphonic acid and hydroxyethylidenediphosphonic acid.

The builders referred to above can be used by themselves but are preferably used in admixture. Sodium disilicate, sodium carbonate, trisodium orthophosphate, tetrasodium pyrophosphate and pentasodium tripolyphosphate are preferably selected.

Detergents generally contain, in addition to surface-active agents and builders, a certain number of conventional ingredients in varying amounts. Examples of these ingredients are agents which make it possible to control foam, such as polysiloxanes, inorganic salts such as sodium sulfate, bleaching agents such as hydrogen peroxide and its hydrates, peroxides and per-salts, by themselves or in admixture with bleaching precursors and other anti-redeposition agents such as carboxymethylcellulose, carboxymethylhydroxyethylcellulose, polyvinyl alcohol, maleic acid/vinyl ether copolymers, acrylic acid by itself or copolymerized with vinyl monomers, and water-soluble sulfonated polyesters, fluorescent brighteners, such as stilbenes, furanes and thiophenes, and also small amounts of perfume, colorants and enzymes.

The anti-soiling and anti-redeposition compositions according to the invention are introduced at the rate of 0.1 to 5% by weight into detergents containing at least 5 to 50% by weight of a surface-active agent. The detergents used preferably contain from 0.3 to 3% by weight of the said compositions of the invention and from 5 to 25% by weight of a surface-active agent.

From 10 to 60%, and preferably from 10 to 40% by weight, of a builder, and from 0 to 30%, and preferably from 10 to 20% by weight, of a bleaching agent can be added to the detergent.

Examples of detergents, with which the new anti-soiling and anti-redeposition compositions of the invention can be formulated, are given below by way of illustration, but without limitation. The percentages given are expressed by weight.

| | |
|---|---|
| Detergent [1] | |
| Linear alkylbenzenesulfonate (the alkyl radical containing about 12 carbons) | 6.2 |
| Natural tallow soap | 4.4 |
| Fatty alcohol containing 18 carbons and comprising 11 ethylene oxide units | 3.2 |
| Sodium tripolyphosphate | 41.3 |
| Sodium sulfate | 12.7 |
| Sodium perborate | 23.2 |
| Carboxymethylcellulose | 0.5 |
| Moisture | 8.5 |
| Detergent [2] | |
| Fatty alcohol containing 14 carbons and comprising 7 ethylene oxide units | 11 |
| Sodium orthophosphate | 4 |
| Sodium pyrophosphate | 10 |
| Sodium tripolyphosphate | 26 |
| Sodium disilicate | 8 |

-continued

| | |
|---|---|
| Sodium sulfate | 13 |
| Sodium perborate | 20 |
| Carboxymethylcellulose | 0.5 |
| Foam regulator (polymethylsiloxane) | 0.5 |
| Moisture | 7 |
| Detergent [3] | |
| Linear alkylbenzenesulfonate (the alkyl radical containing about 12 carbons) | 11 |
| Soap from copra fatty acid | 10 |
| Sodium tripolyphosphate | 40 |
| Sodium disilicate | 5 |
| Sodium sulfate | 20 |
| Enzyme | 1 |
| Moisture | 13 |
| Detergent [4] | |
| Linear alkylbenzenesulfonate (the alkyl radical containing about 12 carbons) | 13.5 |
| Sodium stearate | 1.3 |
| Fatty alcohol containing 18 carbons and comprising 11 ethylene oxide units | 3.7 |
| Sodium orthophosphate | 0.9 |
| Sodium pyrophosphate | 5.8 |
| Sodium tripolyphosphate | 26.5 |
| Sodium disilicate | 4.5 |
| Sodium carbonate | 0.6 |
| Sodium sulfate | 33 |
| Moisture | 10.2 |
| Detergent [5] | |
| Linear alkylbenzenesulfonate (the alkyl radical containing about 12 carbons) | 9.2 |
| Sodium stearate | 6.7 |
| Fatty alcohol containing 18 carbons and comprising 11 ethylene oxide units | 4.8 |
| Sodium orthophosphate | 1.1 |
| Sodium pyrophosphate | 3.4 |
| Sodium tripolyphosphate | 30.2 |
| Sodium disilicate | 6.6 |
| Sodium carbonate | 1.2 |
| Sodium sulfate | 14.2 |
| Sodium perborate | 11.4 |
| Moisture | 11.2 |

The detergents containing the anti-soiling and anti-redeposition compositions according to the invention are suitable for washing all kinds and types of articles based on natural fibers such as cotton, and more particularly for washing textiles which are made from pure or mixed polyester fibers.

The concentration of the anti-soiling and anti-redeposition composition in the washing bath is such that there are at least 5 mg of polymer A per liter of aqueous bath. Of course, the upper limit is in no way of a critical nature, but it is preferred to choose a concentration in the range varying from 5 to 150 mg of polymer A per liter of bath, and very particularly in the range between 15 and 80 mg/liter, because higher concentrations do not bring any advantages in terms of the effectiveness of the products of the invention.

The temperature of the aqueous medium which is used during washing is not critical inasmuch as the anti-soiling and anti-redeposition compositions according to the invention perform effectively at temperatures ranging from about 0° to 100° C. and preferably from 20° to 90° C.

It has also been found that, when incorporated in a detergent powder and stored under conditions approximating practical conditions, the compositions according to the invention reflect, on washing synthetic fibers, an effectiveness which is greater and more stable over time than the products hitherto known in the art.

In order to further illustrate the present invention and the advantages thereof, the following specific examples are given, it being understood that the same are intended only as illustrative, and in nowise limitative.

The immediately following examples illustrate the preparation of the polymer A which will subsequently be employed in the compositions of the invention.

EXAMPLES FOR THE PREPARATION OF THE POLYMER A (1) Polyester-urethane $A_1$ obtained from a polyester base and a prepolymer having terminal isocyanate groups, in accordance with the process hereinafter described.

(a) Preparation of the polyester base 5,952 g (96 mols) of distilled ethylene glycol, 6.5 $cm^3$ of isopropyl orthotitanate and 4,656 g (24 mols) of dimethyl terephthalate were successively charged into a 12 liter reactor equipped with a mechanical stirrer, a column surmounted by a condenser, and means for heating by electrical resistances, the assembly being maintained under nitrogen.

The reaction was regulated so as to obtain a mean degree of polymerization of 2.3. The term "degree of polymerization" denotes the ratio of the total number of structural units to base to the total number of molecules in a given amount of polymer.

To accomplish this, 1,537 g of methanol, which is formed during the reaction, and 3,813 g of ethylene glycol were distilled.

5,258 g of polyester having the following characteristics:

Acid number ($N_a$): 0
Melting point: 190°-195° C.
Mean degree of polymerization: 2.37
were thus obtained.

(b) Preparation of the prepolymer having terminal isocyanate functions 6,000 g of polyoxyethylene glycol having a number-average molecular weight of 1,500 were charged into a 10 liter reactor and dehydrated. The dehydration was carried out under a residual pressure of 20 mm of mercury by heating to a temperature of 105° C. over the course of 1 hour. The temperature was then decreased to 70° C. and the pressure was decreased to atmospheric pressure. 3 g of paratoluenesulfonic acid were than added and the mixture was stirred for 10 minutes. 1,392 g of toluene-diisocyanate were than added rapidly, all at once. The temperature raised and reached 80° C. after stirring for 30 minutes. The reaction mixture was stirred and maintained at this temperature for 2 hours.

7,392 g of a prepolymer containing 4.25% by weight of free isocyanata groups were thus obtained.

(c) Preparation of the polyester-polyurethane $A_1$ 429 g of polyester were charged into a 4 liter reactor equipped with a reflux condenser, a mechanical stirrer and a heated 2 liter dropping funnel and the polyester was gradually heated to a temperature of 220° C. 1,581 g of the prepolymer were charged into the dropping funnel and kept at 70° C. The prepolymer was added over the course of 30 minutes, the temperature of the reactor decreasing uniformly to 10° C. and the mixture was then heated for an additional one hour at this temperature.

2,010 g of polymer $A_1$, having a relative viscosity of 1.77 as a 1% strength solution in N-methylpyrrolidone, were thus obtained.

(2) Polyester-urethane $A_2$ obtained from a polyester base having different characteristics from that employed in the polymer $A_1$.

(a) Preparation of the polyester base

A polyester was prepared in the reactor, in accordance with a conventional method of polyesterification, using 4,314 g (22.2 mols) of dimethyl terephthalate, 1,186 g (4.0 mols) of sodium dimethylisophthalate-sulfonate, 4,868 g (78.5 mols) of ethylene glycol and 2,616 g (8.7 mols) of polyoxyethylene glycol 300.

The final conditions of the condensation were a temperature of 220° C. and a pressure of 5 mm of mercury. The distillate obtained contained 740 g of methanol and 4,263 g of ethylene glycol.

7,981 g of a polyester having the following characteristics:

acid number ($N_a$): 0.3 mg of KOH/g
hydroxyl number ($N_{OH}$): 40 mg of KOH/g
number-average molecular weight ($\overline{M}n$): 2,800
were thus obtained.

(b) Preparation of the prepolymer having terminal isocyanate groups 5,000 g of polyoxyethylene glycol having a number-average molecular weight of 1,500 were charged into a reactor. The said polyoxyethylene glycol was dehydrated in the manner described above. The temperature was brought to 70° C., 2.5 g of para-toluenesulfonic acid were then added and the mixture was stirred for 10 minutes. 1,160 g of toluene-diisocyanate were then added rapidly, all at once. The mixture was allowed to react for 4 hours at a temperature of 70° C.

6,160 g of a prepolymer having 4.55% by weight of terminal isocyanate groups were thus obtained.

(c) Preparation of the polyester-polyurethane $A_2$ 470 g of prepolymer kept at 80° C. were added, over the course of 30 minutes, to 600 g of the polyester prepared above, which was maintained at 220° C. The temperature was allowed to drop to 165° C. and the reaction was then allowed to proceed at this temperature for 2 hours, 35 minutes.

1,070 g of a polymer, having a relative viscosity, measured at 25° C., of 1.6 as a 1% strength solution in N-methylpyrrolidone, were then obtained.

(3) Copolyester $A_3$ 558 g of ethylene glycol and 582 g of dimethyl terephthalate were charged into a 6 liter round-bottomed flask. When the temperature was 95° C., 1 g of isopropyl orthotitanate was added and the heating was continued.

When the temperature reached 170° C., 500 g of dehydrated polyoxyethylene glycol having a number-average molecular weight of 1,500 were added.

The heating was continued up to 200° C. and 181.4 g of methanol were thus distilled.

The distillation was continued under atmospheric pressure, 30 g of distillate being collected. The distillation was continued under a pressure of 100 mm of mercury. 347 g of ethylene glycol were thus distilled. The distillation was brought to an end over the course of 30 minutes under a pressure of 20 mm of mercury and a further 51 g of distillate were collected.

2,055 g of a copolyester having a hydroxyl number of 53 mg/g were then obtained.

The following examples illustrate, without limitation, the novel anti-soiling and anti-redeposition compositions of the invention, the process for their production and their use in detergent compositions.

EXAMPLES 1 to 14

1. Preparation of compositions of the invention containing, in varying proportions:

As the polymer A: the polyester-urethane $A_1$;

As the solubilizing or dispersing agent B: a polyoxyethylene glycol having a number-average molecular weight of 4,000;

As the water repellent C: stearic acid.

The compositions of Examples 1 to 14 combined the same ingredients, but in varying amounts. Some were all prepared in accordance with the method of operation described below.

The polyester-polyurethane $A_1$ was charged into a reactor equipped with a mechanical stirrer, a thermometer and a heated dropping funnel and was maintained at 180° C., under stirring. Polyoxyethylene glycol having a number-average molecular weight of 4,000 was charged into the dropping funnel and heated to the molten state.

The polyoxyethylene glycol was then introduced into the polymer $A_1$ over the course of 15 minutes.

The mixture was homogenized and the stearic acid was then added. The stirring was continued for 15 minutes. The composition was collected in a vat and, after cooling, was ground under conditions such that the particles have an average diameter of 0.5 to 0.8 mm.

The amounts of the various components employed are recorded in Table I (the values in the table are given in grams):

TABLE I

| EXAMPLE No. | POLYESTER-URETHANE $A_1$ | PEG 4,000 B | STEARIC ACID C | WEIGHT RATIOS B/$A_1$ | C/B |
|---|---|---|---|---|---|
| 1 | 100 | 200 | 6 | 2 | 0.03 |
| 2 | 100 | 200 | 10 | 2 | 0.05 |
| 3 | 100 | 200 | 15 | 2 | 0.075 |
| 4 | 100 | 200 | 20 | 2 | 0.10 |
| 5 | 100 | 200 | 50 | 2 | 0.25 |
| 6 | 100 | 200 | 100 | 2 | 0.5 |
| 7 | 100 | 300 | 20 | 3 | 0.066 |
| 8 | 100 | 300 | 40 | 3 | 0.133 |
| 9 | 100 | 300 | 100 | 3 | 0.333 |
| 10 | 100 | 300 | 200 | 3 | 0.666 |
| 11 | 100 | 400 | 20 | 4 | 0.05 |
| 12 | 100 | 400 | 50 | 4 | 0.125 |
| 13 | 100 | 400 | 100 | 4 | 0.25 |
| 14 | 100 | 400 | 200 | 4 | 0.50 |

2. Use of the compositions in detergency

The tests described below demonstrate the anti-soiling properties of the compositions described in Examples 1 to 14 and the retention of the said properties during storage in detergent compositions.

The compositions of the invention which were tested were incorporated at the rate of 0.5% by weight of polymer A in a conventional detergent having the following composition by weight:

| | |
|---|---|
| Linear alkylbenzenesulfonate (the alkyl radical containing about 12 carbons) | 9.5% |
| Fatty alcohol containing 16 to 18 carbons and comprising about 15 ethylene oxide units | 3.2% |
| Sodium stearate | 5.8% |
| Sodium tripolyphosphate | 31% |

-continued

| | |
|---|---|
| Sodium orthophosphate | 1% |
| Sodium pyrophosphate | 3.5% |
| Sodium carbonate | 1% |
| Sodium sulfate | 9% |
| Sodium disilicate | 3% |
| Sodium perborate | 24% |
| Water | 9% |

In order to reproduce the tests satisfactorily, it was checked, before use, that the said detergent possessed a mean moisture content of 10.5% by weight, which corresponds to the loss in weight of a sample kept for 24 hours in an oven at 60° C.

Two series of measurements were carried out on the detergent composition containing the new compositions of the invention: one series determined its initial effectiveness and the other measured its effectiveness after storage for 4 weeks at 40° C.

The first stage consisted of preparing the samples of powder to be tested. To do this, a mixture comprising 100 g of the detergent characterized above and an amount of anti-soiling composition of the invention, which was such that there was 0.5 g of polymer A in the said mixture, was introduced into a 250 $cm^3$ wide-necked jar. The mixture was stirred under defined conditions. Some of the mixtures were tested immediately and others were tested only after having placed the closed wide-necked jars, for 4 weeks, in an oven maintained at a temperature of 40° C. The effectiveness of the mixtures thus prepared was judged by carrying out the test described below.

Polyester fabric (Dacron type 52—Test Fabrics, Inc.), which has undergone a pretreatment consisting of washing same with softened water (5° TH or hardness [French]) in a Miele 421 S automatic machine (60° C. color program), was used for the experiments. The fabric was then dried at ambient temperature.

The samples of fabric underwent the following condition: 50 g of this fabric were washed in the Miele 421 S automatic machine (60° C. color program), one of the doses, prepared beforehand in the wide-necked jars, being used for this washing. The strips of fabric were then dried at ambient temperature and cut into 12×12 cm squares.

4 drops of spent oil were placed on 6 squares of fabric. The stains were then aged for one hour in an oven at 60° C. The reflectance R was measured on an ELREPHO apparatus with a FMY/C filter.

The stained squares were then washed in a LINITEST apparatus, simulating a 60° C. washing cycle, with 3 g/liter of the detergent composition which did not contain the products of the invention. After drying their reflectance $R_1$ was then measured.

The effectiveness of the product tested as an anti-soiling agent was estimated by the percentage removal of the stains, calculated using the formula:

$$E \text{ in } \% = \frac{R_1 - R}{C - R} \times 100$$

C is the reflectance of the unstained fabric before washing.

For each product tested, the mean percentage removal of the stains was calculated.

The results obtained with the compositions of the invention, described in Examples 1 to 14, are recorded in Table II below:

TABLE II

| EXAMPLE No. | WEIGHT RATIOS B/A1 PEG 4,000/ polyester-urethane | C/A1 Stearic acid/ polyester-urethane | INITIAL EFFECTIVENESS | EFFECTIVENESS after storage for 4 weeks at 40° C. |
|---|---|---|---|---|
| 1 | 2 | 0.06 | 67 | 48 |
| 2 | 2 | 0.1 | 68 | 62 |
| 3 | 2 | 0.15 | 71 | 46 |
| 4 | 2 | 0.2 | 68 | 58 |
| 5 | 2 | 0.5 | 69 | 52 |
| 6 | 2 | 1 | 69 | 59 |
| 7 | 3 | 0.2 | 69 | 65 |
| 8 | 3 | 0.4 | 69 | 65 |
| 9 | 3 | 1 | 68 | 63 |
| 10 | 3 | 2 | 69 | 62 |
| 11 | 4 | 0.2 | 71 | 68 |
| 12 | 4 | 0.5 | 72 | 68 |
| 13 | 4 | 1 | 73 | 70 |
| 14 | 4 | 2 | 72 | 62 |

By way of comparison, the following tests were carried out under the same conditions:

EXPERIMENT A

The effectiveness of a detergent which did not contain an anti-soiling adjuvant was measured.

EXPERIMENT B

The effectiveness of a detergent composition containing only the polymer $A_1$, at the rate of 0.5 g per 100 g of detergent, was measured. The polymer $A_1$ was ground in the same manner as above. It was introduced in the form of a powder into the detergent.

EXPERIMENT C

The effectiveness of a detergent composition, which contained a binary mixture comprising the polymer $A_1$ and polyoxyethylene glycol having a number-average molecular weight of 4,000, was measured. The weight ratio of the components of the said mixture ($B/A_1$) was 2.

The amount of binary mixture introduced into the detergent composition was such that the polymer $A_1$ was present in an amount of 0.5 g per 100 g of detergent.

The results of the comparison experiments are summarized in Table III below.

TABLE III

| EXPERIMENT | WEIGHT RATIOS B/A1 PEG 4,000/ polyester-urethane | C/A1 Stearic acid/ polyester-urethane | Initial effectiveness | Effectiveness after storage for 4 weeks at 40° C. |
|---|---|---|---|---|
| A | 0 | 0 | 5 | 5 |
| B | 0 | 0 | 10 | 10 |
| C | 2 | 0 | 70 | 22 |

A study of Tables II and III leads to several observations.

The presence in the washing powder of the compositions of the invention, described in Examples 1 to 14, facilitated the removal of the stains in a remarkable manner, compared with a conventional detergent (Experiment A) and a detergent containing only an anti-soiling and anti-redeposition polymer (Experiment B).

The anti-soiling properties of the compositions of the invention are therefore clearly demonstrated.

On examining the results obtained in Experiments A and B, it is noted that the addition of polyoxyethylene glycol improved the immediate effectiveness of the anti-soiling agent ($A_1$), but that this effectiveness disappeared upon storage.

It has been found that, unexpectedly, the anti-soiling properties of the polymer were retained after storage by adding stearic acid, this being demonstrated by comparing Examples 1 to 6 of the invention with Comparison Experiment C.

As regards Examples 7 to 14, it is noted that, if the amount of polyoxyethylene glycol be further increased relative to that of the polymer, the stability of the properties on storage is improved.

The presence of the three components is essential for improved and stable anti-soiling properties.

EXAMPLES 15 to 17

1. Preparation of compositions of the invntion containing, in varying proportions:
   As the polymer A: the polyester-urethane $A_2$;
   As the solubilizing or dispersing agent B: a polyoxyethylene glycol having a number-average molecular weight of 4,000;
   As the water repellent C: stearic acid.

The compositions of Examples 15 to 17 combined the same ingredients, but in varying amounts. Some were obtained in accordance with the method of operation described below.

The polyester-urethane $A_2$ was charged into a reactor equipped with a mechanical stirrer, a thermometer and a heated dropping funnel and was maintained at 160° C., under stirring. The said polyoxyethylene glycol was charged into the dropping funnel and heated to the molten state. After the polyoxyethylene glycol had been introduced into the polymer, the mixture was homogenized and the stearic acid was then added.

After cooling, the mixture was ground into particles having a diameter of 0.5 to 0.8 mm.

The amounts of the various components employed are recorded in Table IV below (the values in the table are expressed in grams):

TABLE IV

| EXAMPLE No. | POLYESTER-URETHANE $A_2$ | PEG 4,000 B | STEARIC ACID C | WEIGHT RATIOS $B/A_2$ | C/B |
|---|---|---|---|---|---|
| 15 | 100 | 200 | 6 | 2 | 0.03 |
| 16 | 100 | 200 | 15 | 2 | 0.075 |
| 17 | 100 | 200 | 30 | 2 | 0.15 |

2. Use of the compositions in detergency

The effectiveness of the compositions described in Examples 15 to 17 was judged by carrying out the test described in 2 of Examples 1 to 14.

The results obtained with the compositions of the invention are summarized in Table V below.

TABLE V

| EXAMPLE No. | WEIGHT RATIOS B/$A_2$ PEG 4,000/ POLYESTER-URETHANE $A_2$ | C/$A_2$ STEARIC ACID POLYESTER-URETHANE $A_2$ | INITIAL EFFECTIVENESS | EFFECTIVENESS after storage for 4 weeks at 40° C. |
|---|---|---|---|---|
| 15 | 2 | 0.06 | 72 | 48 |
| 16 | 2 | 0.15 | 72 | 51 |
| 17 | 2 | 0.30 | 71 | 57 |

By way of comparison, the following tests were carried out under the same conditions:

EXPERIMENT A

The effectiveness of a detergent, which did not contain an anti-soiling adjuvant, was measured.

EXPERIMENT B

The effectiveness of a detergent composition containing only the polymer $A_2$, at the rate of 0.5 g per 100 g of detergent, was measured. The polymer $A_2$ was ground in the same manner as above. It was introduced in the form of a powder into the detergent.

EXPERIMENT C

The effectiveness of a detergent composition, which contained a binary mixture comprising the polymer $A_2$ and polyoxyethylene glycol having a number-average molecular weight of 4,000, was measured. The weight ratio of the components of the said mixture (B/$A_2$ was 2.)

The amount of binary mixture introduced into the detergent composition was such that the polymer $A_2$ was present in an amount of 0.5 g per 100 g of detergent.

The results of the comparison experiments are summarized in Table VI below:

TABLE VI

| EXPERIMENT NO. | WEIGHT RATIOS B/$A_2$ PEG 4,000/ POLYESTER-URETHANE | C/$A_2$ STEARIC ACID/ POLYESTER-URETHANE | INITIAL EFFECTIVENESS | EFFECTIVENESS after storage for 4 weeks at 40° C. |
|---|---|---|---|---|
| A | 0 | 0 | 5 | 5 |
| B | 0 | 0 | 10 | 10 |
| C | 2 | 0 | 70 | 22 |

Comparative analysis of Tables V and VI shows that the compositions of the invention possess excellent anti-soiling properties and that their effectiveness is retained in a remarkable manner after storage.

EXAMPLE 18

1. Preparation of the following comosition of the invention:

As the polymer A: the copolymer $A_3$;

As the solubilizing or dispersing agent B.: a polyoxyethylene glycol having a number-average molecular weight of 4,000;

As the water repellent C: stearic acid.

The said composition was obtained in accordance with the method of operation described in 1 of Examples 1 to 14.

The proportions of the components of the mixture were as follows:

TABLE VII

| EXAMPLE No. | COPOLYESTER $A_3$ | PEG 4,000 B | STEARIC ACID C | WEIGHT RATIOS B/$A_3$ | C/B |
|---|---|---|---|---|---|
| 18 | 100 | 200 | 30 | 2 | 0.15 |

2. Use of the composition in detergency

This composition was tested under the conditions described, for the compositions, in 2 of Examples 1 to 14.

The results were as follows:

TABLE VIII

| EX. | WEIGHT RATIOS B/$A_3$ PEG 4,000/ COPOLYESTER $A_3$ | C/$A_3$ STEARIC ACID/ COPOLYESTER $A_3$ | INITIAL EFFECTIVENESS | EFFECTIVENESS after storage for 4 weeks at 40° C. |
|---|---|---|---|---|
| 18 | 2 | 0.3 | 38 | 38 |

EXAMPLE 19

1. Preparation of the following composition of the invention:

As the polymer A: the polyester-urethane $A_1$;

As the solubilizing or dispersing agent B: a polyoxyethyleneated fatty alcohol of the formula $$CH_3-(CH_2)_{16}O-(CH_2-CH_2-O)_{50}H$$

the said product being obtained by condensing 50 mols of ethylene oxide with one mol of heptadecanol;

As the water repellent C: stearic acid.

The said composition was prepared in accordance with the method of operation described in 1 of Examples 1 to 14.

The amounts by weight of the components of the mixture were as follows:

TABLE IX

| EXAMPLE No. | POLYESTER-URETHANE $A_1$ | POLYOXYETHYLENEATED FATTY ALCOHOL B | STEARIC ACID C | WEIGHT RATIOS B/$A_1$ | C/B |
|---|---|---|---|---|---|
| 19 | 100 | 100 | 50 | 1 | 0.5 |

2. Use of the composition in detergency

The effectiveness of the said composition was judged by carrying out the test described in 2 of Examples 1 to 14.

The results obtained are recorded in the following table:

TABLE X

| EXAMPLE No. | WEIGHT RATIOS B/$A_1$ POLYOXY-ETHYLENEATED FATTY ALCOHOL/ POLYESTER-URETHANE $A_1$ | C/$A_1$ STEARIC ACID/ POLYESTER-URETHANE $A_1$ | INITIAL EFFECTIVE-NESS | EFFECTIVE-NESS after storage for 4 weeks at 40° C. |
|---|---|---|---|---|
| 19 | 1 | 0.5 | 66 | 59 |

EXAMPLE 20

1. Preparation of the following composition of the invention:

As the polymer A: the polyester-urethane $A_1$;

As the solubilizing or dispersing agent B: a polyoxyethyleneated phenol of the formula:

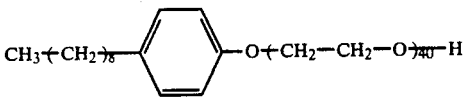

the said product being obtained by condensing 40 mols of ethylene oxide with one mol of nonylphenol;

As the water repellent C: stearic acid.

The composition was prepared in accordance with the process described in 1 of Examples 1 to 14.

The proportions of the components of the mixture were as follows:

TABLE XI

| EXAMPLE No. | POLYESTER-URETHANE $A_1$ | POLYOXY-ETHYLENEATED PHENOL B | STEARIC ACID | WEIGHT RATIOS B/$A_1$ | C/B |
|---|---|---|---|---|---|
| 20 | 100 | 100 | 50 | 1 | 0.5 |

2. Use of the composition in detergency

The said composition was introduced into a detergent and tested under the same conditions as those described in 2 of Examples 1 to 14.

The results of the detergency test were as follows:

TABLE XII

| EXAMPLE No. | WEIGHT RATIOS B/$A_1$ POLYOXY-ETHYLENEATED PHENOL/ POLYESTER-URETHANE $A_1$ | C/$A_1$ STEARIC ACID/ POLYESTER-URETHANE $A_1$ | INITIAL EFFECTIVE-NESS | EFFECTIVENESS After Storage for 4 weeks at 40° C. |
|---|---|---|---|---|
| 20 | 1 | 0.5 | 72 | 60 |

EXAMPLE 21

1. Preparation of the following composition of the invention:

As the polymer A: the polyester-urethane $A_1$;

As the solubilizing or dispersing agent B: an oxyethyleneated tristyrylphenol of the formula:

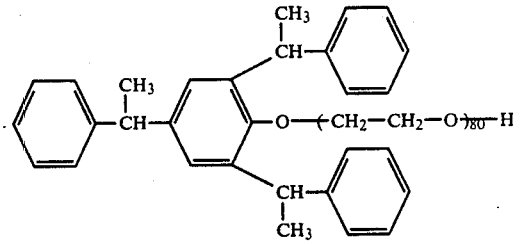

As the water repellent C: stearic acid.

The composition was prepared in accordance with the process described in 1 of Examples 1 to 14.

The proportions of the components of the mixture were as follows:

TABLE XIII

| EXAMPLE No. | POLYESTER-URETHANE $A_1$ | OXYETHYLENEATED TRISTYRYLPHENOL B | STEARIC ACID C | WEIGHT RATIOS B/$A_1$ | C/B |
|---|---|---|---|---|---|
| 21 | 100 | 100 | 50 | 1 | 0.5 |

2. Use of the composition in detergency

The said composition was introduced into a detergent and tested under the same conditions as those described in 2 of Examples 1 to 14.

The results of the detergency test were as follows:

TABLE XIV

| EXAMPLE | WEIGHT RATIOS B/$A_1$ | C/$A_1$ | INITIAL EFFECTIVE-NESS | EFFECTIVE-NESS after storage for 4 weeks at 40° C. |
|---|---|---|---|---|
| 21 | 1 | 0.5 | 72 | 60 |

It is noted that the percentage removal of the stains is high and that the anti-soiling properties of the said composition are retained relatively well on storage in the detergent.

While the invention has now been described in terms of various preferred embodiments and illustrated with respect to certain examples, it will be apparent to the skilled artisan that various omissions, substitutions, modifications and the like may be made without departing from the spirit of the invention. Accordingly, it is intended that the scope of the present invention be limited only by the following claims.

What is claimed is:

1. An anti-soiling and anti-redeposition adjuvant formulation comprising (i) an anti-soiling and anti-redeposition amount of at least one polymer A, said polymer itself having anti-soiling and anti-redeposition properties, wherein said polymer A is selected from the group consisting of a hydrophilic polyurethane, a copolyester and mixtures thereof, (ii) at least one solubilizing and dispersing agent B for the said polymer A, and (iii) at least one water repellent C present in an amount sufficient to act as a water repellent for said agent B.

2. The formulation as defined by claim 1, wherein the polymer A is a hydrophilic polyurethane resulting from the reaction of 10 to 70% by weight of a polyester base, the acid number of which is less than 3 mg of KOH/g and the hydroxyl number of which is less than or equal to 375 mg of KOH/g, with 90 to 30% by weight of a prepolymer having terminal isocyanate groups, which is obtained by reacting at least one non-ionic hydrophilic macrodiol with at least one diisocyanate, the ratio of NCO/OH being between 0.8 and 1.

3. The formulation as defined by claim 1, wherein the polymer A is a copolyester comprising recurring units of alkylene terephthalate and of polyoxyalkylene terephthalate.

4. The formulation as defined by claim 2, wherein the polymer A is a polyurethane resulting from the reaction of a polyester base which has a number-average molecular weight of 300 to 4,000 and comprises the condensation product of an acid selected from the group consisting of adipic acid or ester-forming derivatives thereof, terephthalic acid or ester-forming derivative thereof, sulfoisophthalic acid in the form of its sodium salt or ester-forming derivative thereof, and mixtures thereof, and at least one diol selected from the group consisting of ethylene glycol, diethylene glycol and higher homologues having a molecular weight which is less than or equal to 300, butane-1,3-diol and propane-1,2-diol, with a prepolymer having terminal isocyanate groups, and which is obtained by reacting at least one polyoxyethylene glycol, having a molecular weight of between 600 and 4,000, with at least one diisocyanate selected from the group consisting of hexamethylene-diisocyanate, toluene-diisocyanate and di-(isocyanatophenyl)-methane.

5. The formulation as defined by claim 3, wherein the polymer A is a copolyester comprising recurring units of ethylene terephthalate and of polyoxyethylene terephthalate.

6. The formulation as defined by claim 1, wherein the solubilizing and dispersing agent B is soluble in water and has a melting point between 35° and 150° C.

7. The formulation as defined by claims 1 or 6, wherein the solubilizing and dispersing agent B is selected from the group consisting of:

polyoxyethylene glycols having a number-average molecular weight of between 1,000 and 30,000, or fatty acid ester or diester thereof;

the non-ionic surface-active agents obtained by condensing ethylene oxide with an aliphatic or alkylaromatic co-reactant;

urea, N-alkylureas containing from 1 to 4 carbon atoms in the alkyl radical and N,N- or N,N'-dialkylureas containing 1 to 2 carbon atoms in the alkyl radical;

the mono- or diglycerides obtained from gylcerol and aliphatic fatty acids having from 12 to 20 carbon atoms;

amides of aliphatic carboxylic acids possessing from 2 to 8 carbon atoms; and

α-hydroxylic aliphatic carboxylic acids having from 2 to 5 carbon atoms.

8. The formulation as defined by claim 6, wherein the solubilizing and dispersing agent B is selected from the group consisting of:

polyoxyethylene glycols having a number-average molecular weight ranging from 2,000 to 8,000;

polyoxyethyleneated aliphatic alcohols resulting from the condensation of ethylene oxide with linear or branched chain fatty alcohols having from 8 to 22 carbon atoms, at the rate of 40 to 80 mols of ethylene oxide per mol of fatty alcohol;

polyoxyethyleneated alkylphenols obtained by condensing ethylene oxide with alkylphenols, at the rate of 40 to 80 mols of ethylene oxide per mol of alkylphenol, the alkyl radical being linear or branched and containing from 6 to 12 carbon atoms;

polyoxyethyleneated tristyrylphenols which have the structural formula:

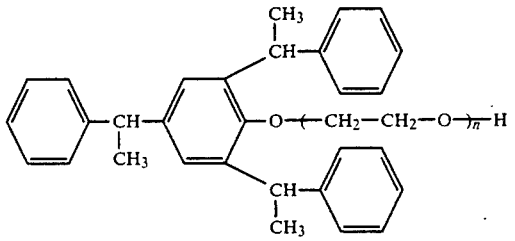

in which n can vary between 5 and 80.

9. The formulation as defined by claim 1, wherein the water repellent C has a melting point between 35° and 150° C.

10. The formulation as defined by claims 1 or 9, wherein the water repellent C is selected from the group consisting of:

linear or branched chain saturated fatty acids having from 12 to 22 carbon atoms; and microcrystalline waxes obtained by mixing normal paraffins, branched paraffins and naphthenic hydrocarbons having from 36 to 60 carbon atoms.

11. The formulation as defined by claim 10, wherein the water repellent C is stearic acid.

12. The formulation as defined by claim 1, wherein the weight ratio of solubilizing and dispersing agent B to polymer A is between 0.5 and 5.

13. The formulation as defined by claim 12, wherein the weight ratio of water repellent C to solubilizing and dispersing agent B is between 0.03 and 1.

14. The formulation as defined by claim 1, wherein same is in the form of a powder consisting essentially of particles having a diameter which is less than or equal to 2 mm.

15. The formulation as defined by claim 14, wherein same essentially consists of a mixture of the polymer A, the solubilizing or dispersing agent B and the water repellent C, in amounts such that the weight ratios of solubilizing and dispersing agent B to polymer A and of water repellent C to solubilizing and dispersing agent B are respectively from 1 to 4 and from 0.1 to 0.4, and wherein same is in the form of fine particles having a diameter of between 0.5 and 1 mm.

16. A process for the preparation of the formulation as defined by claim 1, comprising heating the polymer A to a temperature between 100° and 200° C., adding thereto the solubilizing and dispersing agent B, homogenizing the mixture which results, and thence adding thereto water repellent C.

17. The process as defined by claim 16, wherein the mixture obtained is ground under conditions such that the resultant particles have a diameter which is less than or equal to 2 mm.

18. The formulation as defined by claim 6, the said solubilizing and dispersing agent B having a melting point between 35° and 90° C.

19. The formulation as defined by claim 8, wherein n varies between 30 and 80.

20. The formulation as defined by claim 9, the said water repellent C having a melting point between 35° and 90° C.

21. The formulation as defined by claim 12, the said weight ratio being between 1 and 4.

22. The formulation as defined by claim 13, the said weight ratio being between 0.1 and 0.4.

23. A detergent composition comprising a detergent surfactant and the formulation as defined by claim 1.

24. The detergent composition as defined by claim 23, further comprising a detergent builder.

25. The detergent composition as defined by claim 24, further comprising at least one member selected from the group consisting of a foam-controlling agent, an inorganic salt, a bleaching agent, another anti-redeposition agent, an optical brightener, a perfume, a colorant and an enzyme.

26. The composition as defined by claim 24, comprising from 0.1 to 5% by weight of said formulation, and from 5 to 50% by weight of said surfactant.

27. The composition as defined by claim 26, comprising from 0.3 to 3% by weight of said formulation, and from 5 to 25% by weight of said surfactant.

28. The composition as defined by claim 26, comprising from 10 to 60% by weight of said detergent builder.

29. The composition as defined by claim 28, further comprising from 10 to 20% by weight of a bleaching agent.

30. An aqueous washing bath comprising the detergent composition as defined by claim 24.

31. The washing bath as defined by claim 30, comprising at least 5 mg of polymer A per liter of aqueous bath.

32. The washing bath as defined by claim 31, comprising from 15 to 80 mg of polymer A per liter of aqueous bath.

33. In the washing of a textile article in an aqueous washing bath, the improvement which comprises utilizing as the detergent therefor, the detergent composition as defined by claim 24.

34. The washing as defined by claim 33, the same being conducted at a temperature of from 0° to 100° C.

35. The washing as defined by claim 34, the same being conducted at a temperature of from 20° to 90° C.

36. The washing as defined by claim 33, said textile article comprising synthetic polyester fibers.

* * * * *

UNITED STATES PATENT AND TRADEMARK OFFICE

CERTIFICATE OF CORRECTION

PATENT NO. : 4,240,918

DATED : December 23, 1980

INVENTOR(S) : Alain Lagasse et al

It is certified that error appears in the above—identified patent and that said Letters Patent is hereby corrected as shown below:

Column 7, line 49, correct "othophosphates" to read

-- orthophosphates --:

Column 16. line 26, correct "invntion" to read -- invention --;

Column 17, line 59, correct "comosition" to read --composition--;

Column 18, line 48. correct

"$CH_3-(CH_2)_{16}\ O-(CH_2-CH_2-O)_{50}-H$" to read

-- $CH_3-(CH_2)_{16}-O-(CH_2-CH_2-O)_{50}\ H$ --.

Signed and Sealed this

*Twenty-fourth* Day of *August 1982*

[SEAL]

*Attest:*

GERALD J. MOSSINGHOFF

*Attesting Officer*

*Commissioner of Patents and Trademarks*